United States Patent [19]

Almasi et al.

[11] 4,359,048

[45] Nov. 16, 1982

[54] AUTOMATICALLY STARTABLE OXYGEN RESCUE DEVICE

[75] Inventors: Istvan Almasi; Ferenc Kassai, both of Budapest; Laszlo Nyeste, Ecser, all of Hungary

[73] Assignee: Banyaszati Aknamelyito Vallalat, Budapest, Hungary

[21] Appl. No.: 7,471

[22] Filed: Jan. 26, 1979

[51] Int. Cl.[3] ..... A62B 7/00

[52] U.S. Cl. ..... 128/205.12; 128/205.17; 128/205.24; 128/205.22

[58] Field of Search ..... 128/202.26, 204.26, 128/205.28, 205.22, 205.12, 205.17, 205.24, 205.25, 204.28; 422/123

[56] References Cited

U.S. PATENT DOCUMENTS

| | | | |
|---|---|---|---|
| 2,492,272 | 12/1949 | Dauster | 128/202.26 |
| 2,854,001 | 9/1958 | Humblet | 128/204.26 |
| 3,390,676 | 7/1968 | Warncke et al. | 128/204.28 |
| 3,607,122 | 9/1971 | Hwoschinsky | 128/202.26 |
| 3,881,394 | 5/1975 | Netteland | 128/202.26 |
| 3,981,302 | 9/1976 | Veit | 128/202.26 |
| 4,205,673 | 6/1980 | Wise et al. | 128/202.26 |
| 4,230,667 | 10/1980 | Williams | 128/202.26 |

FOREIGN PATENT DOCUMENTS

| | | | |
|---|---|---|---|
| 685582 | 12/1939 | Fed. Rep. of Germany . | |
| 1080404 | 4/1960 | Fed. Rep. of Germany . | |
| 1164831 | 3/1964 | Fed. Rep. of Germany . | |
| 1210327 | 2/1966 | Fed. Rep. of Germany . | |
| 1261403 | 2/1968 | Fed. Rep. of Germany . | |
| 656628 | 3/1979 | U.S.S.R. | 128/205.22 |

*Primary Examiner*—Henry J. Recla
*Attorney, Agent, or Firm*—Karl F. Ross

[57] ABSTRACT

The invention relates to an automatically operating oxygen rescue apparatus whose case consists of a housing portion and a cover attached thereto, with the case holding an oxygen bottle, a regeneration cartridge, an oxygen metering valve system, and a breathing tube, with the housing portion having an impact device whose impact head can be made to contact the surface of the cover; the movable part of the impact device is operatively connected to the oxygen valve or to a valve on the oxygen bottle. The oxygen metering valve system contains lines for constant oxygen metering, automatic metering by a regulator and supplemental metering, all of which discharge into a breathing tube.

With the rescue apparatus of the invention, the impact device can be started with a single motion. Actuating the impact device causes not only the case to open, but also the release of oxygen. The triple oxygen metering is adapted to the needs of the escaping person and can secure optimum air supply during escape from disaster.

6 Claims, 13 Drawing Figures

AUTOMATICALLY STARTABLE OXYGEN RESCUE DEVICE

FIELD OF THE INVENTION

The invention relates to an operable oxygen rescue apparatus which is automatically startable into operation and which is particularly suitable to prevent suffocation and to assure escape in case of sudden gas leaks.

BACKGROUND OF THE INVENTION

In mining, various types of oxygen rescue devices are used. Starting the operation, i.e., the preparation of the devices for use, is fairly time-consuming. Starting the devices in most cases is even more delayed by the wrong measures used by people and attributed to the external danger effects, even with the greatest effort and forced calm; this in turn is a serious source of hazard. Therefore, maximum reliability is being sought in the design of rescue apparatus, with the devices being started quickly and simply. Quick starting so far has not been satisfactorily achieved with the known oxygen rescue devices.

With the known types, access to the most important components of the rescue device could be had only in such a way that first the carrying case had to be opened with a composite series of motions, and only then could, for example, the valve of the oxygen bottle be opened with another motion. Because of the complicated series of motions, the device could not be started without a thought process, with a single instinctive motion, even though it would have been desirable because of the tense psychological condition of the escaping person.

During escape (from danger) with the known rescue devices, besides the constant metering, either oxygen metering controlled by an automatic regulator unit or extra-oxygen metering should be added to ensure rescue. The physical and pyschological condition of the escaping person is strongly influenced by the mode of operation of the rescue device, or by the air quantity obtained from the device and suitable for resuscitation. During escape, the oxygen consumption increases considerably because of the hasty movement.

So far there has not been developed such an oxygen metering system for rescue devices to assure the greatly fluctuating oxygen requirement of the escaping person exposed to heavy physical stress in a suitable manner.

OBJECTS OF THE INVENTION

The object of the present invention is to provide an improved breathing apparatus in which the opening of the case and the opening of the oxygen valve can be accomplished by means of a suitable mechanism by a single motion and that the oxygen requirement of the escaping person may be best satisfied by a triply combined oxygen metering system.

SUMMARY OF THE INVENTION

The problem posed is solved by constructing the case of the automatically starting oxygen rescue apparatus of a housing portion and a cover connected thereto, and placing in the case an oxygen bottle, an oxygen-metering valve system, an alkali cartridge with an airbag and a breathing hose. In the housing portion, there is an impact device whose impact head can be brought into impact contact with the cover and the movable part of the impact device is operatively connected to the oxygen valve of the oxygen bottle, plus the oxygen-metering valve system having conduits to the constant oxygen metering, automatic regulator metering and free-flow metering, which discharge in a common breathing tube.

With the apparatus of the present invention, the impact device can be set into operation with a single motion and when actuated, not only opens the carrying case, but also the valve. The triple oxygen metering system is adapted to the requirements of the escaping person and during escape may ensure an optimum air supply.

BRIEF DESCRIPTION OF THE DRAWING

The above and other objects, features and advantages of the invention will become more readily apparent from the following description, reference being made to the accompanying drawing, in which.

SPECIFIC DESCRIPTION

Figure 2:
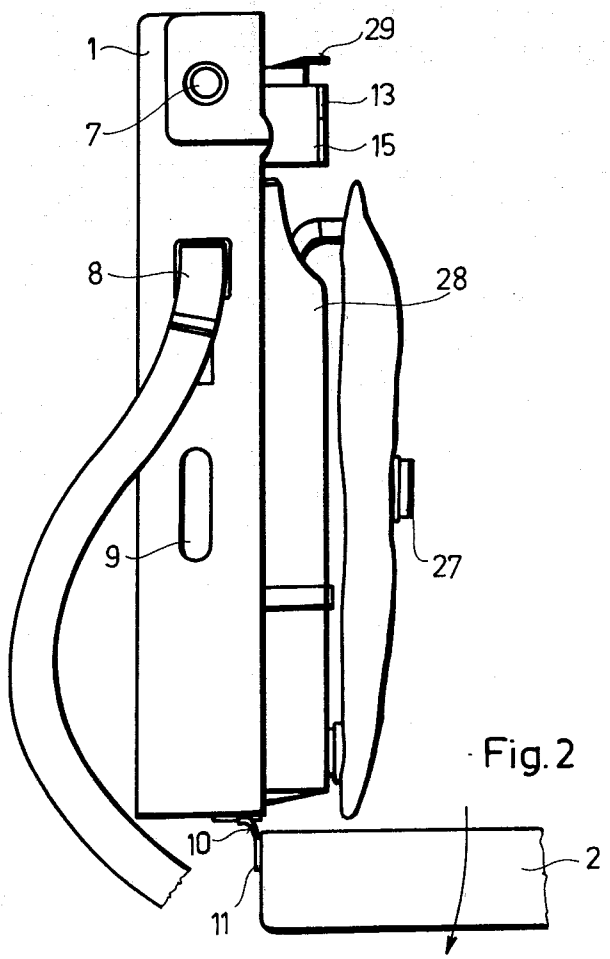
FIG. 2 is a side view of the rescue device of FIG. 1.
Figure 1:
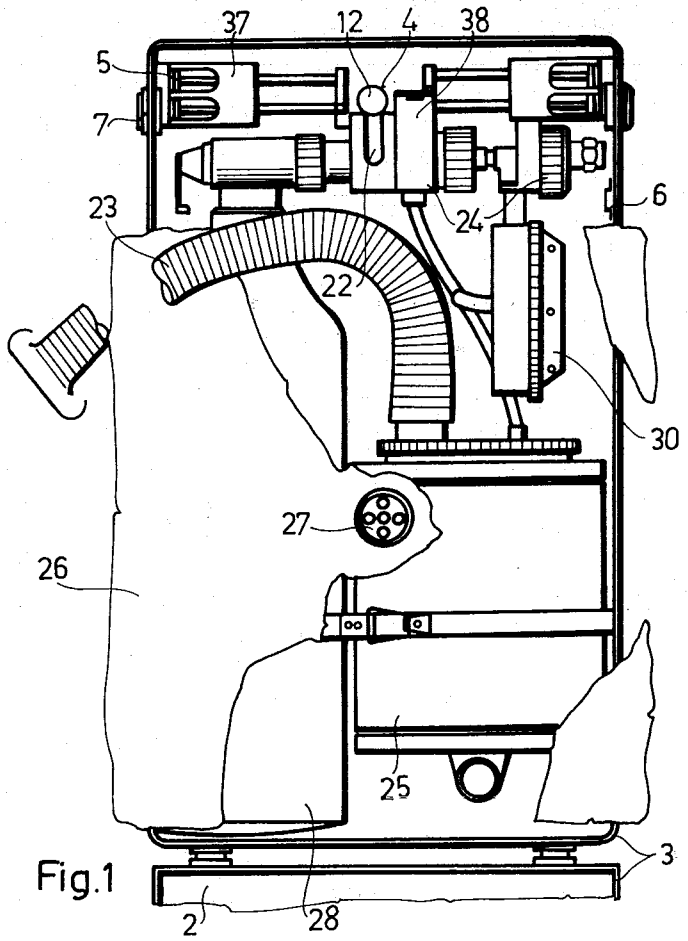
FIG. 1 is a front view of the complete carrying case of the rescue device according to the invention, with the cover open.
Figure 3:
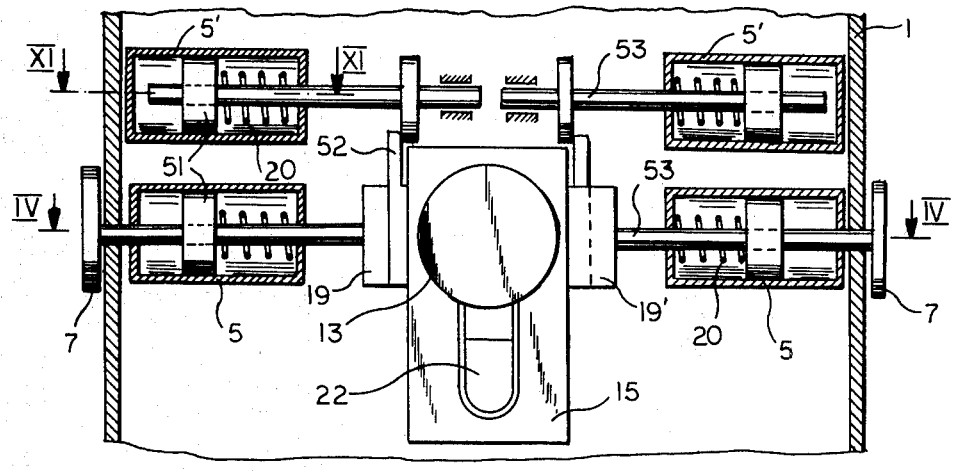
FIG. 3 is a sectional view taken along line III—III of FIG. 4 showing the impact device.
Figure 4:
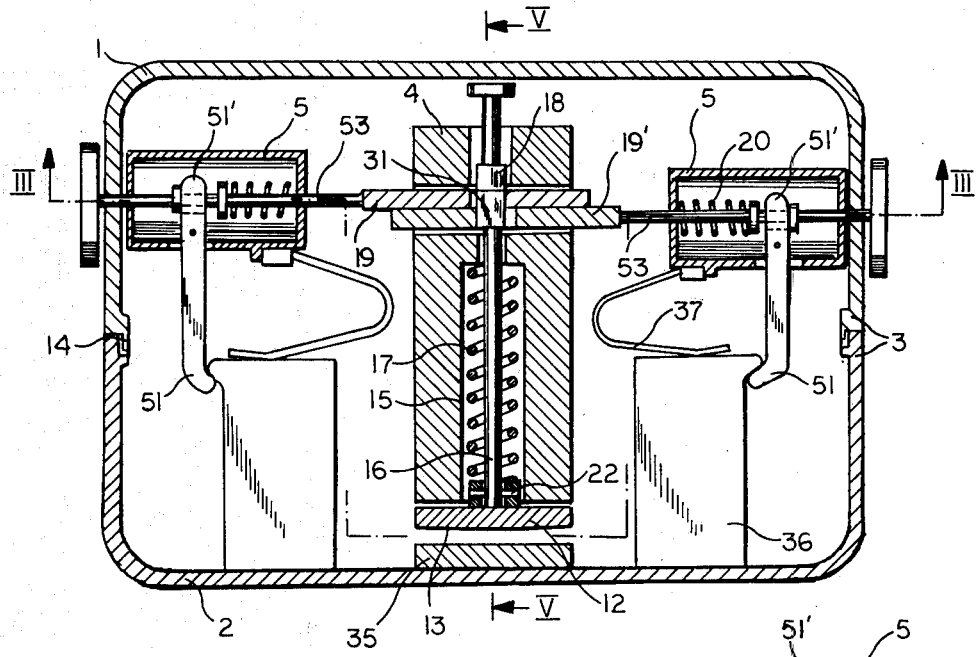
FIG. 4 is a section taken along line IV—IV of FIG. 3.
Figure 11:
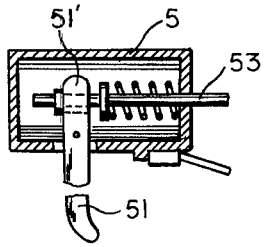
FIG. 11 is a sectional view taken along line XI—XI of FIG. 3.

FIGS. 1 and 2 show the carrying case 3 of the breathing apparatus according to the invention. The case 3 consists of two parts, the components required for the functioning of the apparatus located in housing portion 1 thereof, with a cover 2 hinged to this housing portion. On the lower part of housing opening 1 is a hinge opening 10 which is connected to the hinge plate 11 of cover 2. The resulting hinge joint permits the flipping of cover 2 into an open position. The invention relates mainly to the connection of housing portion 1 and cover 2. The top part of cover 2 is connected to the housing 1 by two pairs of identical lid locks 5 and 5'. The lid locks 5 are arranged over and under each other on both sides of the housing. FIGS. 3 and 4 show the arrangement and the manner of connection of lid locks 5 and 5'. The housing 1 and cover 2 have matching rims and a gasket 14 is located between the rims. The hinged latches 51, which have bifurcated ends 51' which flank and are engaged by connecting rods 53 of lid locks 5 and 5', can be pivoted outwardly and engage closure catches 36 which protrude from the cover 2. The lid locks 5 and 5' are equipped with springs 37 which produce tension between cover 2 and the housing 1, resting against the face areas of closure catches 36. This tension causes the flipping open of the cover 2 at the instant when the locked condition produced by lid locks 5 and 5' is discontinued.

Carrying strap connections 8 and operating openings 9 are located on the side surfaces of case 3, as shown in FIG. 2. The inner space of case 3 is filled mainly by the components required for the functioning of the breathing apparatus. The drawing shows an oxygen bottle 28, an alkali cartridge 25, a regulator system 24, a valve 30 controlled by the breathing requirements of the user, and a breathing hose 23 with attached mouthpiece. Between the housing 1 and the cover 2 is an air bag 26 which has a bleeder valve 27 at its middle section.

Opening of case 3 and the starting of the apparatus is accomplished by the impact device 4 whose action is released by simultaneously pressing the triggers or start buttons 7 located on both sides near the top of the housing. The impact device 4 is also located near the top of the housing 1 and its construction is explained based on FIGS. 3 and 4.

The impact device 4 is located close to other components in a closure device housing 15. The impact device 4 is located in such a way so that the contact area 13 of its impact head 12 is directed towards the cover 2 and the start buttons 7 of FIG. 3 are located on both sides of housing 1. Inside the closure device housing 15, an impact rod 16 is preloaded by a buffer spring 17. The end of impact rod 16 is rigidly connected to the impact head 12 and pivotally to a pressure switch lever 22. The end of the pressure switch lever 22 has a projection and makes point contact with an oxygen stop valve 21 as shown in FIG. 5.

Extension of the start buttons 7 are each connected to blocking plates 19 and 19' through the lid locks 5. The extension of the start buttons 7 are loaded by the start springs 20, which are located in the lid locks 5 and through which they pass, in the position shown in FIG. 3. The hinged latchs 51 of the lid locks 5 are directly actuated by the extensions of triggers 7, as shown in FIG. 4. FIG. 3 shows that on each of the blocking plates 19 and 19' there is a finger 52 by which the lid locks 5' are actuated by pushing against the disks mounted on their extensions. The pushing-in of each blocking plate results in the release of facing lid locks 5 and 5', and hence breaking the connection of housing 1 and cover 2 requires the simultaneous pressing-in of both plates 19 and 19'. This simultaneous pressed-in position is the requirement for unlocking impact device 4.

Figure 5:
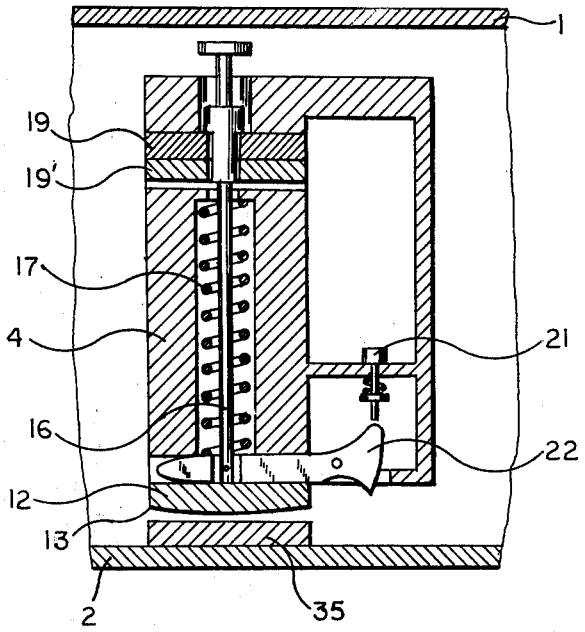
FIG. 5 shows the connection of the impact device and the oxygen valve in a section taken along line V—V of FIG. 4.
Figure 6:
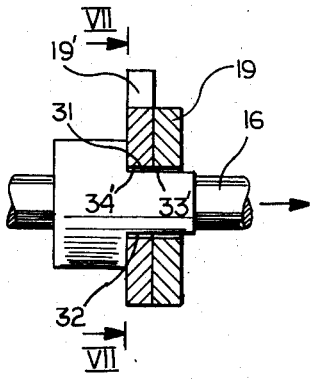
FIG. 6 shows an enlarged sectional view of the interlock-connection between the formation on the impact rod and the blocking plates.
Figure 7:
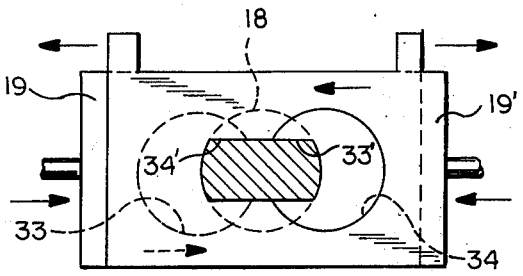
FIG. 7 shows a section taken along line VII—VII of FIG. 6.
Figure 8:
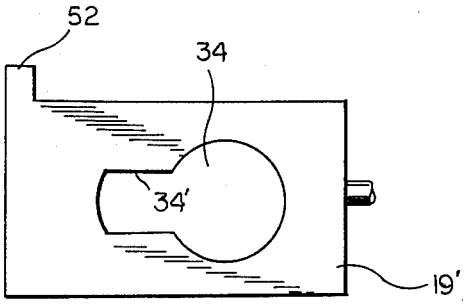
FIG. 8 is a front view of a blocking plate of FIG. 7.

The impact rod is held by a formation 18 thereon in the position of FIGS. 4 and 5, with the impact rod 16 being loaded by the compression force of impact spring 17. FIGS. 6, 7 and 8 show an advantageous embodiment of formation 18. On the formation 18, two symmetrical flats 31 and 32 are formed. The width of flats 31 and 32 is slightly larger than the joint thickness of plates 19 and 19' connected to the blocking buttons 7 (FIG. 6). The start plates are freely shiftable relative to each other along the flats 31 and 32 by pushing in the start buttons 7, but the axial shifting of the impact rod 16 is prevented by the cylindrical portion of formation 18.

As evident from FIGS. 2, 3 and 4, the plates 19 and 19' are preloaded by trigger springs 20. Both plates 19 and 19' have in the region of formation 18 an opening 33 and 34, respectively, each opening being dimensioned to allow passage of the cylindrical portion of formation 18, openings 33 and 34 having respective slots 33' and 34' flanking flats 31 and 32 in the loaded position (FIGS. 7 and 8). The openings are located in the loaded position of the impact device 4 to the right or left, respectively, of the axis of impact rod 16. FIGS. 6 and 7 show that the opening 34 of the right-hand projecting into plate 19' projecting into is shifted to the right in relation to formation 18. The opening 33 of the left-hand plate 19 is shifted to the left in relation to the formation 18.

To free the impact rod 16, the plates 19 and 19' must both be pushed in, with plate 19' shifted to the left and plate 19 being shifted to the right. When the openings 33 and 34 are axially aligned with the cross section of the formation, the formation of the impact rod 16 is released and the impact head 12 is driven by the impact spring 17 with great force against cover 2. At the same time, the pressure switch lever 22 (FIG. 5) moves and the oxygen valve is pushed in by the projecting end of the pressure switch lever. This sets the oxygen bottle of the rescue device in operation and the device starts to function automatically. At the same time, the contact surface 13 of the impact head 12 strikes the facing support surface 35 of cover 2 (FIG. 4) and this impact is sufficient for opening the interlock produced by the lid locks 5. In this manner, cover 2 is flipped about hinge 10 and the inside of the rescue device becomes accessible.

Since the release of the impact rod 16 and the start of oxygen delivery requires simultaneous pushing of both trigger buttons 7, the possibility of accidental release is completely eliminated.

In order to reset the impact device 4 to the original loaded position, the impact head 12 must be pressed against the force of impact spring 17 and as soon as the flats 31 and 32 align with the switch openings 33 and 34 of the blocking plates 19 and 19', the plates 19 and 19' are set by the start springs 20 to the original position, locking the impact rod 16 in the loaded position.

The escaping person may push the trigger buttons 7 by a single motion made from both sides, and by releasing the impact device 4, the rescue device is immediately placed in readiness.

On the basis of the principle explained above, other, similarly activated impact devices may be constructed. The essence of the invention is that the impact head 12 and the spring 17 by the simultaneous pushing-in of the two start buttons 7 strike the cover 2 with great force and the oxygen valve of the oxygen bottle is brought to the open position at the same time.

Figures 9A, 9B, 9C:
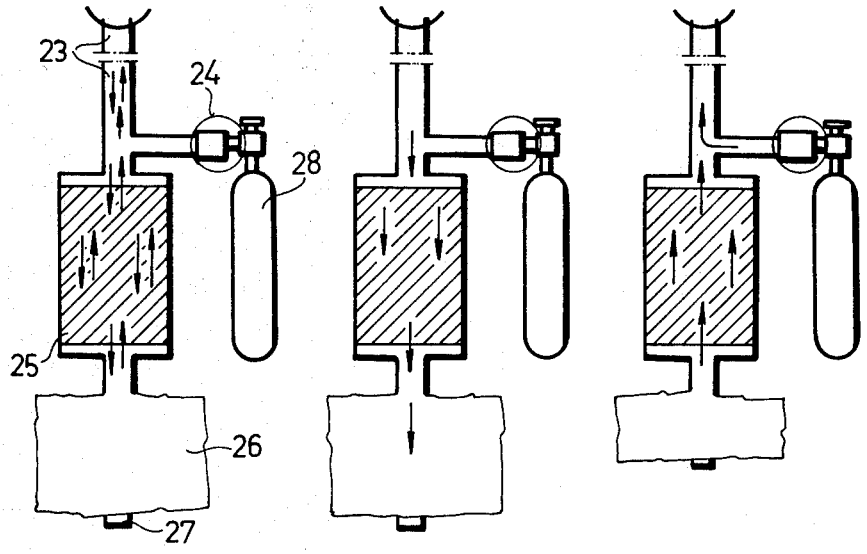
FIG. 9*a* is a schematic showing the operational principle of the oxygen metering system.
FIG. 9*b* is a schematic similar to FIG. 9*a* showing the flow condition during exhaling.
FIG. 9*c* is shows a schematic similar to FIG. 9*a* showing the flow conditions during inhaling.

FIGS. 9*a*, 9*b* and 9*c* show a schematic of the oxygen metering system of the rescue device in accordance with the invention. From the principal arrangement of the oxygen metering system it is evident that the oxygen is delivered from the oxygen bottle 28 via a valve system 24 to the breathing hose 23 whose end has a mouthpiece. The mouthpiece is connected by the breathing hose 23 with an alkali cartridge 25 for filtering and regenerating the exhaled air, and an air bag 26 is connected to the alkali cartridge. The air bag 26 is provided directly or indirectly with a bleeder valve 27 in order to relieve the overpressure possibly arising in the respiratory system.

The device operates independently of the ambient atmospheric air pressure and has a closed breathing system. The consumed oxygen is replaced from the oxygen bottle 28 by the metering and pressure-reducing valve system.

Figure 10:
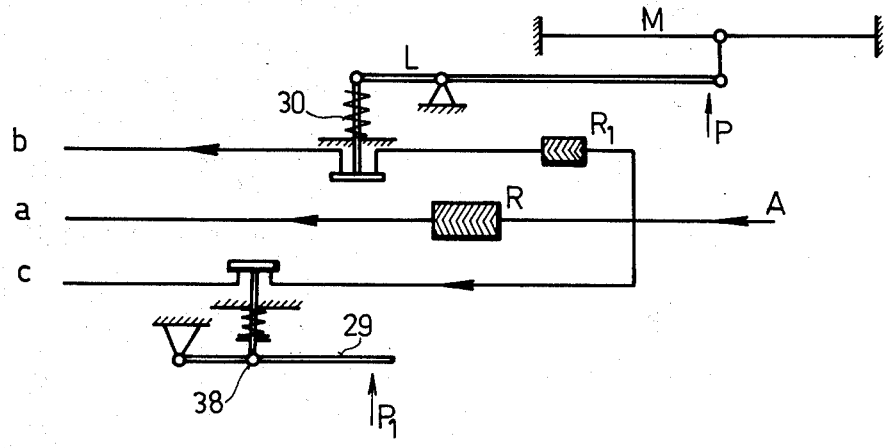
FIG. 10 is a schematic of the the oxygen-metering valve system.

FIG. 10 shows the schematic of the mode of operation of valve system 24. The oxygen is supplied by the oxygen valve 21 of oxygen bottle 28 to the valve system 24 from the direction of arrow A. The delivered oxygen is divided into three branches a. The middle branch is connected to valve 21 and has a pressure reducer R installed in this branch. The constant oxygen metering proceeds via line a. The upper branch b is connected via another pressure reducer $R_1$ to a regulator valve 30, responsive to the breathing requirements of the user. The lever arm L of the regulator valve is connected with a metering diaphragm M, which when displaced into another position, moves the lever arm L and the flow of oxygen to branch b is adjusted. Free shifting of lever arm L is prevented by a spring installed in the valve. The force P required for overcoming the spring force is produced by the inhalation of the user. The movement of the metering membrane M is thus caused by the suction effect of the lung which secures the inflow of oxygen. This process is repeated during every breathing cycle.

The valve system 24 is supplemented with additional metering. Branch c receives the oxygen from the oxygen bottle 27 directly via a supplemental metering valve 38. The opening of the supplemental metering valve 38 can be initiated by the escaping person by depressing the oxygen metering lever 29 (FIG. 2). This device is necessary because the escaping persons, as shown by experience, frequently consider the oxygen quantity delivered to them by the regulator too small for various psychological and other reasons and the supplemental metering valve 38 provides the possibility of quickly satisfying the increased oxygen requirement.

The branch lines a, b and c discharge into the common breathing hose 23. In FIG. 10 the air flow directions during inhaling are shown schematically.

The advantage of the rescue device according to the invention is that the extradordinary psychological condition of the escaping person and the resulting requirements are fully taken into consideration, and the automatic starting of the device, i.e., the opening of the case and the start of oxygen delivery, is made possible by a single motion.

The constant oxygen metering of the triple oxygen supply system serves to secure the normally required oxygen quantity, the regulator secures a supplemental oxygen quantity corresponding to the breathing rhythm during increased load, and the supplemental metering satisfies any suddenly increased oxygen requirement.

The supplemental metering also has the advantage in that the heated air is cooled by the oxygen admitted from the oxygen bottle suddenly into the respiratory system during its expansion, improving the psychological effect of the breathing cycle and the general well-being of the escaping person.

We claim:

1. An automatic portable breathing apparatus comprising:

a housing;

a cover hinged to said housing and swingable between a closed position wherein said cover defines an enclosure with said housing, and an open position;

an oxygen bottle mounted in said housing;

an alkali filter mounted in said housing;

an air bag contained in said enclosure and communicating with said filter;

a breathing tube contained in said enclosure and communicating with said oxygen bottle and said filter;

a stop valve in said housing between said oxygen bottle and said breathing tube and said filter;

catch means mounted in said housing and engageable with said cover for maintaining same in said closed position;

a force storing device mounted in said housing including means adapted to release a force and operatively connected to said stop valve for opening same upon release of said force, said device also being positioned to engage and drive open said cover upon release of said force for allowing access to said breathing tube and expansion of said air bag; and trigger means operatively connected to said catch means and said force storing device for releasing same.

2. The apparatus defined in claim 1 wherein said force storing device is a spring-loaded plunger lying perpendicular to the pivot axis of said cover and having a head formed at one end thereof and engageable with said cover, said plunger being further provided with a formation releasably engageable with said trigger means.

3. The apparatus defined in claim 2 wherein said trigger means comprises at least one displaceable rod extending through a wall of said housing and formed at the outer end thereof with a second head and at the inner end thereof with a plate having an opening formed therein through which said plunger passes, a portion of said opening having a shape corresponding to that of the formation, which is normally biased out of alignment with said formation into a blocking position thereof by a spring acting on said rod to displace said second head away from said housing.

4. The apparatus defined in claim 3 wherein said catch means includes at least one detent formed on said cover and engageable by a finger pivotally mounted in said housing and operatively connected with said rod and at least one auxiliary spring mounted in said housing and acting on said cover to bias same into an open position.

5. The apparatus defined in claim 4 wherein a pair of said trigger means and a pair of said catch means is provided in said breathing apparatus, said apparatus being operable only when said pair of trigger means is activated simultaneously.

6. The apparatus defined in claim 1, further comprising:

a pressure reducer connected between said stop valve and said breathing tube;

a regulator, responsive to the breathing requirements of a user, connected in parallel with said pressure reducer; and a supplemental valve connected in parallel with said pressure reducer and said regulator, said supplemental valve being operable to provide unrestricted oxygen flow to said breathing tube.

* * * * *